US010737753B1

(12) United States Patent
Gonring

(10) Patent No.: US 10,737,753 B1
(45) Date of Patent: Aug. 11, 2020

(54) BILGE PUMP MONITORING SYSTEM AND METHOD

(71) Applicant: Brunswick Corporation, Mettawa, IL (US)

(72) Inventor: Steven J. Gonring, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 25 days.

(21) Appl. No.: 16/006,418

(22) Filed: Jun. 12, 2018

(51) Int. Cl.

| | |
|---|---|
| ***B63J 99/00*** | (2009.01) |
| ***G07C 5/08*** | (2006.01) |
| ***B63B 13/00*** | (2006.01) |
| ***B63B 79/00*** | (2020.01) |

(52) U.S. Cl.
CPC ..... *B63J 99/00* (2013.01); *B63B 13/00* (2013.01); *G07C 5/0808* (2013.01); *B63B 79/00* (2020.01)

(58) Field of Classification Search
CPC ..... B63J 99/00; B63J 2099/006; B63B 13/00; G07C 5/0808
See application file for complete search history.

(56) References Cited

U.S. PATENT DOCUMENTS 4,050,396 A 9/1977 Ridgeway
4,697,515 A 10/1987 Germann
5,467,643 A * 11/1995 Barnett ..... B63J 99/00 73/114.68
5,516,312 A 5/1996 Reed
5,576,582 A * 11/1996 White ..... B63B 13/00 307/118
6,469,641 B1 10/2002 Lash et al.
6,473,004 B1 10/2002 Smull
6,553,336 B1 * 4/2003 Johnson ..... G01D 3/022 702/188
7,661,380 B2 2/2010 Waldecker
8,676,402 B1 * 3/2014 Foster ..... B63C 15/00 114/44
8,944,865 B1 2/2015 Krabacher et al.
9,397,604 B2 * 7/2016 Oakley ..... H02P 29/60
2002/0190687 A1 * 12/2002 Bell ..... B63J 4/006 318/778
2005/0192727 A1 * 9/2005 Shostak ..... B60C 11/24 701/37
2006/0026017 A1 * 2/2006 Walker ..... H04L 63/302 701/31.4
2006/0206246 A1 * 9/2006 Walker ..... G06Q 10/00 701/16
2006/0212194 A1 * 9/2006 Breed ..... G07C 5/008 701/1
2008/0140278 A1 * 6/2008 Breed ..... G06F 8/65 701/31.4

(Continued)

*Primary Examiner* — Behrang Badii
*Assistant Examiner* — Daniel L Greene
(74) *Attorney, Agent, or Firm* — Andrus Intellectual Property Law, LLP

(57) ABSTRACT

A bilge pump monitoring system for a bilge pump on a marine vessel includes a current sensor configured to measure a current draw of the bilge pump, and a bilge pump monitor module executable on a processor. The bilge pump monitor module is configured to receive current draw measurements by the current sensor and determine a pump diagnosis of the bilge pump based on the current draw measurements. The pump diagnosis is then wirelessly communicated to a user located remotely from the marine vessel.

20 Claims, 6 Drawing Sheets

(56) References Cited

U.S. PATENT DOCUMENTS

| | | | | |
|---|---|---|---|---|
| 2008/0258663 | A1* | 10/2008 | Walls | H02P 7/2913<br>318/459 |
| 2009/0212740 | A1* | 8/2009 | Felps | H01M 10/425<br>320/134 |
| 2013/0271301 | A1* | 10/2013 | Kabel | B63B 49/00<br>340/987 |
| 2014/0048004 | A1* | 2/2014 | Russick | B63B 13/00<br>114/183 R |
| 2014/0266793 | A1* | 9/2014 | Velado | G08B 25/08<br>340/870.16 |
| 2018/0072384 | A1* | 3/2018 | von Mueller | H04L 67/025 |
| 2018/0262131 | A1* | 9/2018 | Russick | B63B 13/00 |

* cited by examiner

| OPERATING MODE | CURRENT DRAW | PUMP-ON DURATION | ASSUMPTION | DIAGNOSIS |
|---|---|---|---|---|
| AUTOMATIC WATER LEVEL (TURNED ON BY FLOAT SWITCH) | <1 AMP | | PUMP IS NOT RUNNING | BLOWN FUSE, FAILED MOTOR, FAILED WIRE HARNESS, POOR GROUND |
| | 1–2 AMPS | | WATER IS NOT PRESENT | CLOGGED INLET, FAILED FLOAT SWITCH |
| | 2–4 AMPS | SHORTER THAN NORMAL | WATER IS PRESENT, BUT EMPTYING TOO QUICKLY | FAILED / INTERMITTENT FL OAT SWITCH |
| | 2–4 AMPS | NORMAL | WORKING CORRECTLY | NORMAL |
| | 3–4 AMPS | LONGER THAN NORMAL | WATER IS PRESENT, BUT EMPTYING TOO SLOWLY | CLOGGED OUTLET, HEAVY RAIN, MAJOR LEAK |
| | <4 AMPS | | DRAWING TOO MUCH CURRENT | FAILED MOTOR, STUCK IMPELLOR |
| MANUAL (TURNED ON BY DASH SWITCH) | <1 AMP | | PUMP IS NOT TURNING ON | BLOWN FUSE, FAILED MOTOR, FAILED WIRE HARNESS, POOR GROUND, FAILED DASHBOARD SWITCH |
| | 1–2 AMPS | | WORKING CORRECTLY | NORMAL – NO WATER PRESENT |
| | 2–4 AMPS | | WORKING CORRECTLY | NORMAL – WATER PRESENT |
| | >4 AMPS | | DRAWING TOO MUCH CURRENT | FAILED MOTOR, STUCK IMPELLOR |
| SYSTEM CONTROL (TURNED ON BY CONTROLLING RELAY IN PUCK) | <1 AMP | | PUMP IS NOT TURNING ON | BLOWN FUSE, FAILED MOTOR, FAILED WIRE HARNESS, POOR GROUND |
| | 1–2 AMPS | | WORKING CORRECTLY | NORMAL – NO WATER PRESENT |
| | 2–4 AMPS | SHORTER THAN NORMAL EQUAL TO NORMAL | WORKING CORRECTLY | NORMAL – WATER PRESENT |
| | 2–4 AMPS | LONGER THAN NORMAL | WATER IS PRESENT, BUT EMPTYING TOO SLOWLY | CLOGGED OUTLET, HEAVY RAIN, MAJOR LEAK |
| | >4 AMPS | | DRAWING TOO MUCH CURRENT | FAILED MOTOR, STUCK IMPELLOR, FAILED HARNESS |

FIG. 6

BILGE PUMP MONITORING SYSTEM AND METHOD

FIELD

The present disclosure relates to bilge pump systems for marine vessels, and more specifically to monitoring systems for detecting and diagnosing problems related to bilge pumps on marine vessels, and providing remote notification to users regarding bilge pump operation.

BACKGROUND

The following U.S. Patents and Applications provide background information. Each reference is incorporated herein by reference in its entirety.

U.S. Pat. No. 4,050,396 discloses a portable water bailing device including a housing having a plurality of openings therein adjacent the lower end thereof. Within the housing is a water pump connected to a tube for directing the water from the bottom of the boat outwardly over the edges thereof. The water pump is driven by a direct current motor which is connected in series with a battery. Also in series with the battery and motor is a limit switch which is actuated by a float within the housing. As the water rises within the housing, the float actuates the switch which in turn actuates the pump.

U.S. Pat. No. 4,697,515 discloses a marine safety system comprising a first switch adapted to be activated by rising water in a ship's hull, and solenoid valves adapted to be operated by the switch and adapted to close sea cocks in the hull of the ship in a preferred sequence.

U.S. Pat. No. 5,516,312 discloses a device for sensing the presence of hull water above an acceptable level in the hull of a boat and communicating to any combination of ignition, starter, aural and/or visible means in such manner as to cause the boats engine to stop running and apprise the boat operator as to the presence of excessive hull water.

U.S. Pat. No. 7,661,380 discloses an improved bilge water level monitor, alert and control system for boats and other vessels. The system provides a method of detecting excessive leakage of water into the bilge and in response to the excessive water in the bilge, triggering an alarm to notify the operator and others and energizes bilge pumps to remove the excessive water. The system is designed with many redundancies in the sub elements and subsystems for safety. The system provides a means for reducing the likelihood of exhausting battery power in the event of a significant seawater leakage problem. The electrical power rating of the monitoring circuitry components is relatively low, thereby reducing the size and weight of those components relative to prior bilge pump monitoring and alert systems. There is no electrical wiring exposed to bilge water during system operation thereby reducing damage to the wiring components. The water level detection and control circuitry operates with sufficiently low amperage to substantially eliminate the hazard of spark-induced combustion.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a bilge pump monitoring system for a bilge pump on a marine vessel includes a current sensor configured to measure a current draw of the bilge pump, and a bilge pump monitor module executable on a processor. The bilge pump monitor module is configured to receive current draw measurements by the current sensor and determine a pump diagnosis of the bilge pump based on the current draw measurements. The pump diagnosis is then wirelessly communicated to a user located remotely from the marine vessel.

One embodiment of a method of monitoring a bilge pump on a marine vessel includes operating a current sensor to measure a current draw of the bilge pump, and acquiring the current draw measurements over two or more pump cycles of the bilge pump. At least one normal operating value for the bilge pump is determined based on the acquired current draw measurements and the at least one normal operating value is stored in a memory of a storage system accessible by the processor. The current sensor is then operated to measure a current draw of the bilge pump during an ongoing pump cycle. A pump diagnosis for the bilge pump is then determined based on the current draw measurements for the ongoing pump cycle and the at least one normal operating value. In certain embodiments, the pump diagnosis may then be wirelessly communicated to a user located remotely from the marine vessel.

Various other features, objects, and advantages of the invention will be made apparent from the following description taken together with the drawings.

BRIEF DESCRIPTION OF THE DRAWINGS

The present disclosure is described with reference to the following Figures.

FIG. 6 is a table exemplifying diagnoses based current draw inputs for certain operating modes.

DETAILED DESCRIPTION

Marine vessels, which are valuable assets, are often left unattended on moorings or at docks, and thus are often vulnerable to the elements and the malfunctioning of onboard equipment. For example, all marine vessels accumulate water in the bilge area. Bilge pumps are standard, which are activated to pump water out of the bilge once the water level in the bilge area reaches a certain level. Various water level monitoring system and bilge pump activation systems exist that automatically activate the bilge pump when a threshold amount of water accumulates in the bilge. Once the bilge pump has evacuated the water, the bilge pump is pump is automatically turned off. If any element in the system, including the switch, the power system to the bilge pump, or the bilge pump itself stops operating properly, then the marine vessel can take on excess water and be damaged. Absent vessel owners often have limited resources for monitoring the condition of their bilge pump system, and thus the water level condition on their vessel.

Accordingly, the inventors have recognized a need for a bilge pump monitoring system and method that allows users to remotely monitor bilge pump operation on the marine vessel. Moreover, the inventors have recognized that a bilge pump monitoring system and method are needed that, in addition to determining whether a bilge pump is operating or not operating, is able to diagnose problems with a bilge pump system with specificity and accuracy, and provide such information remotely to the user. Additionally, the inventors have recognized that a bilge pump monitoring system and method are needed that can automatically and remotely operate the bilge pump, such as to compensate for malfunctioning activation switches.

While some bilge pump monitoring systems are available that monitor bilge pump activity, such existing systems monitor bilge pump activity based on voltage measurements at the bilge pump. In such systems, it is assumed that if voltage is present, the pump is running. Likewise, such systems assume that the pump is not running is voltage is not present. These assumptions can be incorrect, and at the very least are insufficient to detect and diagnose common problems with bilge systems, including with the bilge pump itself, the water level switch, the electrical supply thereto, etc.

Figure 1:
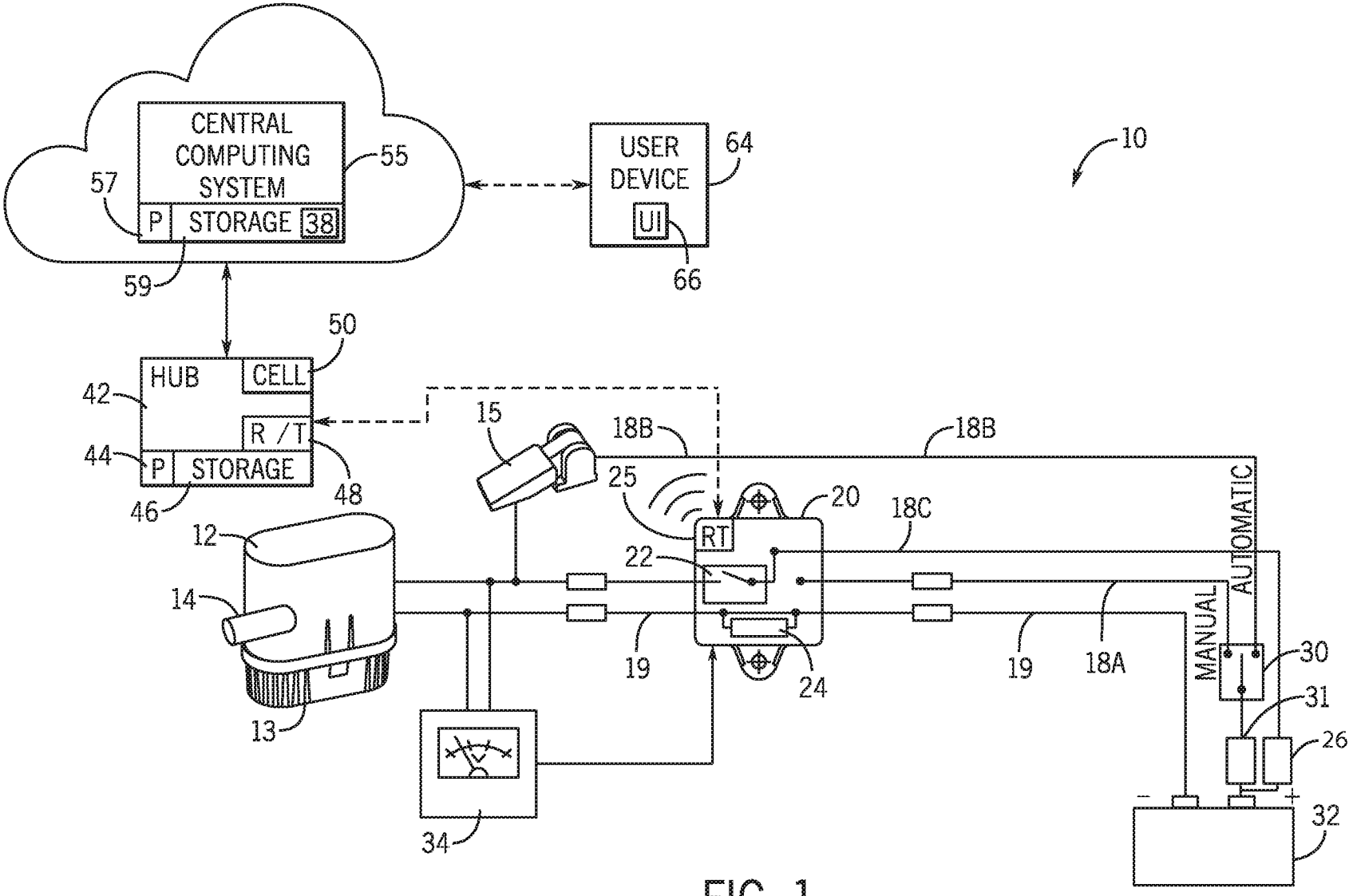
FIG. 1 is a schematic diagram depicting an exemplary bilge pump monitoring system.

As a result of their recognition of the foregoing problems and challenges with prior art systems, the inventors developed the disclosed system and method for bilge pump monitoring and operation. FIG. 1 depicts an exemplary bilge pump monitoring system 10. The system 10 includes a bilge pump 12 powered by a battery 32. Circuitry is provided that connects the bilge pump 12 to the battery 32 for selective operation, as is described in more detail below. The bilge pump 12 has a pump inlet 13 that takes in water from the bilge compartment and a pump outlet 14 that outputs the pumped water for evacuation from the marine vessel. The pump outlet 14 connects to a hose (not shown) that carries the pumped water to a location outside of the marine vessel.

In the example in FIG. 1, the bilge pump 12 can be activated in three different ways. The bilge pump 12 can be activated manually by a user by operating the dash switch 30 to manually turn on the bilge pump. In the depicted embodiment, the dash switch 30 is a three-way switch accessible by an operator on the marine vessel, such as provided on the dash at the helm of the marine vessel. The three-way switch provides a manual on position that connects the positive wire 18*a* to the positive terminal on the battery 32. In the off mode, no connection between the positive terminal of the battery 32 and the bilge pump 12 is possible (except for embodiments having a relay 22 providing remote activation control, as is described in more detail below).

In automatic mode, the power connection between the bilge pump 12 and the battery 32 is provided through a water level activation switch 15, which in the depicted embodiment is a float switch. Namely, the switch 15 closes when the water level in the bilge reaches a threshold level, thus activating the bilge pump 12 to remove the water that has built up. Float switches are well known in the relevant art and are standard in bilge pump applications. However, other systems are also known and available for monitoring water level in the bilge and automatically activating the pump when the water reaches a predefined level. Any such system may be provided as the water level activation switch 15 for activating the bilge pump 12 when the water level in the bilge reaches a threshold level. In certain embodiments, the switch 15 may be incorporated into the bilge pump 12, and such systems will be known to a person having ordinary skill in the art and will operate substantially the same as the example shown and described in FIG. 1. In other embodiments, the dash switch 30 may be a two-way switch between manual and automatic, where no off position is provided.

A fuse 31 is provided between the dash switch 30 and the battery 32, which will be tripped if the current draw exceeds the relevant threshold. In other embodiments, the fuse 31 may instead be a circuit breaker or other safety device that prevents excess amount of current draw by the motor of the bilge pump 12. Once the fuse 31 is blown, or the circuit is otherwise broken, both positive wires 18*a* and 18*b* become disconnected from the battery 32 the bilge pump cannot be powered. Thus, for example, if the dash switch 30 is in the automatic position, the bilge pump 12 cannot be activated by the float switch 15. In prior art systems, water is left to accumulate in the bilge when the fuse 31 is blown because no means is provided for activating the bilge pump 12.

The inventors developed the disclosed system which includes a bilge control puck 20 electrically connected into the wiring between the battery 32 and the bilge pump 12 to allow activation of the bilge pump 12 that bypasses the dash switch 30, as well as the fuse 31. The bilge control puck 20 also enables remote monitoring and control of the bilge pump 12. Circuit 18*c* powers the puck 20, which has its own fuse 26 that is separate from fuse 30 between the battery 32 and the dash switch 30. In the depicted embodiment, the bilge control puck 20 has an internal relay 22 that connects circuit 18*c* to power the bilge pump 12. For example, the relay 22 may be closed to power the bilge pump 12 in the event of a blown fuse 31 or a faulty water level activation switch 15.

In the depicted example, the wire 18*a* from the dash switch 30 is an input to the bilge control puck 20, which indicates that the dash switch 30 is in the manual position and the operator has manually turned on the bilge pump 12. In the depicted embodiment, the bilge control puck 20 is configured to close the relay 22 to turn on the bilge pump 12 when the dash switch 30 is in the manual position. Thereby, the bilge control puck 20 is able to determine the position of the dash switch 30. For example, if the bilge pump 12 is running and the relay is open, then it can be determined that the dash switch 30 is in the automatic position and that the bilge pump 12 was turned on via the switch 15. Moreover, because the positive wire 18*c* bypasses the fuse 31, the bilge pump 12 can still be powered even if the fuse 31 is blown.

The system further includes a current sensor 24 that measures a current draw of the bilge pump 12. In the depicted embodiment, the current sensor 24 is an integrated shunt within the bilge control puck 20, such as an ammeter shunt that allows measurement of the current value through the negative wire 19 (the negative path to the battery 32). The current sensor 24 thus measures the amount of current being consumed by the pump, which may be a continuous measurement or periodic measurements conducted at predetermined sample intervals. Based on the measured current, it can be determined if the pump is on. Additionally, significant information can be determined about the operation of the pump based on the current measurements, especially based on the current measurements acquired over time. As explained in more detail below, trend analysis can be conducted based on the current draw measurements of the bilge pump over time, which can be used to determine normal operation values of the pump, as well as how pump operation changes (which may be gradual change overtime or a sudden malfunction).

In the depicted embodiment, the current sensor 24 is provided within the bilge control puck 20, which has a wireless transceiver 25 capable of two-way wireless communication with a computing system. In the depicted embodiment, the current draw measurements from the current sensor 24 are communicated to a hub computing system 42 on the marine vessel via wireless communication between the wireless transceiver 25 in the bilge control puck 20 and a wireless transceiver 48 within the hub computing system 42. In certain embodiments, the bilge control puck 20 may also communicate additional information to the hub computing system 42, including the position of the relay 22 (i.e., open or closed) and whether the dash switch 30 is in the manual mode, and thus the bilge control puck 20 is connected to the battery 32 via positive wire 18*a*. In various embodiments, the transceiver 25 of the bilge control puck 20 may communicate with other devices, including the transceiver 48 in the hub computing system 42, to transmit and receive data, which may be accomplished through any of the various radio protocols known in the art. Exemplary wireless protocols that could be used for this purpose include, but are not limited to, Bluetooth®, Bluetooth Low Energy (BLE), ANT, and ZigBee. Alternatively, communication between the bilge control puck 20 and the hub computing system 42 may be by wired means, such as by a direct galvanic connection.

In certain embodiments, the system 10 may further include a voltage sensor 34 measuring the voltage across the bilge pump 12. The voltage measurements may be communicated by wired or wireless means. In the depicted example, the voltage measurements are communicated from the voltage sensor 34 to the bilge control puck 20, which then communicates the voltage measurements to the hub computing system 42. In other embodiments, the voltage sensor 34 may communicate directly with the hub computing system 42, which may be by wired or wireless means. The voltage measurements provide information about operation of the bilge pump 12, which can be used to supplement and/or confirm information gleaned from the current draw measurements. In certain embodiments, a second voltage sensor may also be provided at the battery to measure the voltage thereof.

The system 10 further includes a bilge monitor module 38, which is a set of software instructions executable to monitor the bilge pump 12 and determine a pump diagnosis based on the current draw and/or voltage measurements. The bilge monitor module 38 may further be configured to allow remote control of the bilge pump 12, which may be automated control or based on control inputs provided by a user to remotely turn on and off the bilge pump 12. In various embodiments, the bilge monitor module 38 may comprise instructions entirely housed within a central computing system 55, such as a computing system hosted and accessible via a cloud network. The central computing system 55 includes a processing system 57 and a storage system 59 accessible by the processing system 57. The bilge monitor module 38 may be a set of software instructions stored within the storage system 59 and executable by the processing system 57 to operate as described herein, including determining a pump diagnosis based on the current draw measurements and/or to control the bilge pump 12 as described herein.

Various computing system architectures are possible and within the scope of the disclosed system and method, as will be understood by person having ordinary skill in the art in light of this disclosure. In the depicted embodiment, the hub computing system 42 communicates with the central computing system 55 via a mobile broadband network (e.g., via 3G or 4G broadband cellular network technology). The hub computing system 42 includes a cell chip 50 enabling such cellular communication with the central computing system 55, such as for transferring information provided by the bilge control puck 20 for analysis by the bilge monitor module 38. In such an embodiment, the central computing system 55 may receive information from multiple different hub computing systems 42 on multiple different marine vessels, providing centralized computing and control for bilge systems on many different marine vessels located any where in the world where a cell connection is possible. In other embodiments, other communication means may be employed between the hub computing system 42 and the central computing system 55, such as via satellite internet service. Such communication means may be provided as an alternative to, or in addition to, the cell chip 50 providing cellular network access.

The hub computing system 42 includes a processing system 44 and a storage system 46. In certain embodiments, some or all of the software instructions comprising the bilge monitor module 38 may be stored within the storage system 46 and executed by the processing system 44 of the hub computing system 42. Accordingly, some or all of the operations disclosed herein may be performed on the marine vessel by the hub computing system 42. In such embodiments, the hub computing system 42 may communicate directly with a user device 64, such as to provide the pump diagnosis and/or other information relating to the bilge system.

The processing systems 44 and 57 each include one or more processors, which may each be a microprocessor, a general purpose central processing unit, an application-specific processor, a microcontroller, or any other type of logic-based device. The processing systems 44 and 57 may also include circuitry that retrieves and executes software from the respective storage system 46, 59. Each processing system 44, 57 may be implemented with a single processing device, but may also be distributed across multiple processing devices or subsystems that cooperate in executing program instructions.

The storage systems 46 and 59 can comprise any storage media, or group of storage media, readable by the respective processing system 44, 57, and capable of storing software. Each storage system 46, 59 may include volatile and non-volatile, removable and non-removable media implemented in any method or technology for storing information, such as computer-readable instructions, program modules comprising such instructions, data structures, etc. Each storage system 46, 59 may be implemented as a single storage device, but may also be implemented across multiple storage devices or subsystems. Examples of storage media include random access memory, read only memory, optical discs, flash memory, virtual memory, and non-virtual memory, or any other medium which can be used to store the desired information and that may be accessed by an instruction execution system, as well as any combination of variation thereof. The storage media may be housed locally with the processing system 44, 57, or may be distributed, such as distributed on one or more network servers, such as in cloud computing applications and systems. In some implementations, the storage media is non-transitory storage media. In some implementations, at least a portion of the storage media may be transitory.

The bilge monitor module 38 is further configured to facilitate communication between the bilge pump monitoring system 10 and a user device 64. The user device 64 may be any computing device accessible by a user to communicate with the central computing system 55 (or, in certain embodiments, directly with the hub computing system 42), such as a cell phone, laptop, or other personal computing device. The user device 64 includes a user interface 66 that presents information to the user, such as the pump diagnosis and/or other information about the bilge pump 12. Additionally, the user interface 66 may be configured to allow a user to input operation controls for controlling the bilge pump. For example, the user interface 66 may be configured to allow a user to instruct that the bilge pump be turned on or off. Such instructions are sent from the user device to the central computing system 55, which then communicates with the hub computing system 42. The hub computing system 42 then communicates control instructions to the bilge control puck 20 to open or close the relay 22 in accordance with the user instructions. As described above, in certain embodiments, the user device 64 may communicate directly with the hub computing system 42. In such an embodiment, the user instructions may be provided directly from the user device 64 to the hub computing system 42.

Figure 2:
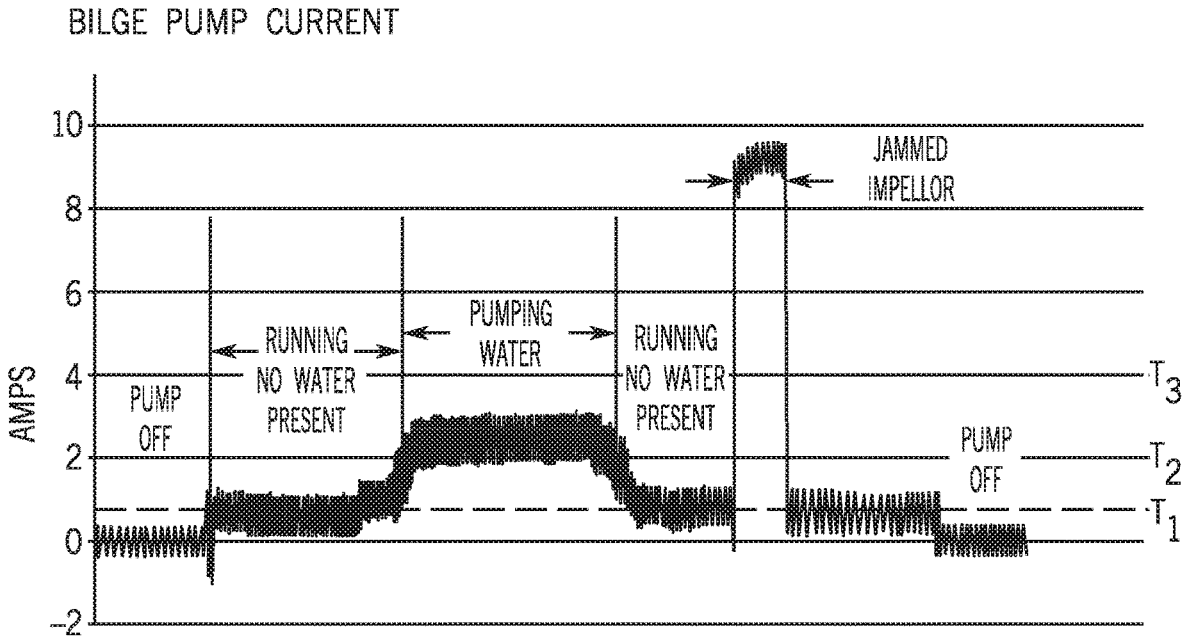
FIG. 2 is a graph showing current measurements during various operation stages of an exemplary bilge pump.

The bilge monitor module 38 receives and analyses the current draw measurements made by the current sensor 24. Such current draw measurements can be used to determine information about the current operation of the bilge pump 12. FIG. 2 provides a graph illustrating current measurements for an exemplary bilge pump during various operation stages. When the pump is off, or is not drawing sufficient current for operation, the current draw measurements will be around 0, or at least less than a first threshold $T_1$. Thus, if the current sensor 24 is measuring a current draw that is less than threshold $T_1$, then it can be determined that the pump is off, or at least that the pump motor is not operating.

If the pump motor is operating, then the current draw measurements will be greater than or equal to the first threshold $T_1$. As shown in FIG. 2, the current draw by the bilge pump 12 exceeds the first threshold $T_1$ when the motor is running but no water is present, and thus the bilge pump is not pumping water through the outlet 14 and out of the output hose. The current draw of the bilge pump 12 increases further, such as above a second threshold $T_2$, when the bilge pump 12 is operating to pump water out of the marine vessel. Thus, it can be determined based on the current draw whether water is in the bilge that is being pumped by the bilge pump 12. If no water is sitting in the bilge, and the bilge pump 12 is operating, then the current draw will be between the first threshold $T_1$ and the second threshold $T_2$. If water is in the bilge and the pump is operating to remove it, then the current draw by the bilge pump 12 will exceed the second threshold $T_2$.

The current draw will not exceed a third threshold $T_3$ unless there is a problem with the bilge pump 12. For example, a seized motor or jammed impeller may cause a sudden spike in current draw as the motor consumes more current in an attempt to continue its pumping operation. As exemplified in FIG. 2, if the current draw exceeds the third threshold $T_3$, the system can diagnose that the bilge pump 12 is experiencing a seized motor. The various threshold and operating current values are for example purposes only. The actual threshold values for a particular application will vary depending on the particular bilge pump and pump system arrangement being monitored.

Accordingly, a bilge pump diagnosis may be determined by comparing the current draw measurements measured by the current sensor 24 during an ingoing pump cycle, and how those current draw measurements compare to one or more thresholds. The thresholds may be preset values, such as based on the pump model being monitored and/or the power configuration therefore. Additionally, the bilge monitor module 38 may be configured to determine one or more normal operating values for the bilge pump 12 based on acquired current draw measurements over time—i.e. over multiple pump cycles executed during the normal operation of the bilge pump. Outside of extenuating circumstances, such as a major leak or heavy rain allowing abnormally high amounts of water into the bilge, the bilge pump 12 will run at a fairly regular cycle. For example, if the bilge pump 12 is operating in an automatic mode such that a water level switch 15 is controlling the cycling of the bilge pump-on and off, the bilge pump will cycle on and off at a fairly regular interval. Accordingly, a normal cycle interval for a bilge pump can be determined based on the current draw information gathered over a period of time, such as a period of days or weeks.

The normal cycle interval may vary based on external conditions, such as seasonal conditions or based on varying locations of the marine vessel. Thus, the normal cycle interval determined based on the normal current draw values may vary over an extended period of time, such as weeks or months. For example, the normal cycle interval may vary based on seasonal conditions or a change in a geographical location of the marine vessel—i.e., based on changes in the amount of rainfall. The normal cycle interval calculation can remain sufficiently updated by, for example, constraining the amount of data used to calculate the normal cycle interval. For example, the normal cycle interval may be calculated based on a predetermined number of previous pump cycles, or based on the current draw measurements gathered over a predetermined amount of time (such as based on the previous few days worth of data). Other normal operating values may likewise be calculated.

Figure 3:
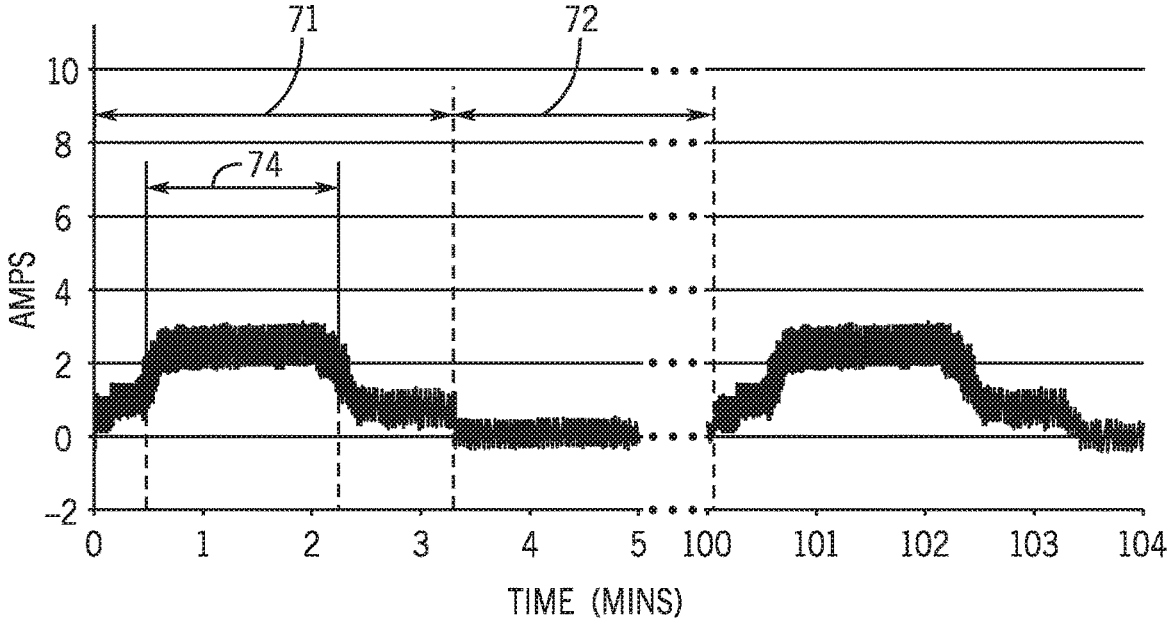
FIG. 3 is a graph depicting current draw measurements over an exemplary pump cycle.

FIG. 3 illustrates current draw measurements acquired over two pump cycles, where a pump cycle represents a full on/off interval of the bilge pump 12. A pump cycle may be divided into a pump-on duration 71 and a pump-off duration 72, where the pump-on duration is the period of time for which the current draw exceeds the first threshold $T_1$ indicating that the pump is on. The pump-off duration is the period of time during which the pump is turned off, such as from the time that the current draw measurement falls below the first threshold $T_1$ until the bilge pump 12 turns back on and the current draw rises back above the first threshold $T_1$. In the depicted example, the current draw is provided over time, measured in minutes. The pump-on duration 71 is approximately 3.5 minutes. The pump-off cycle is much longer, and in the depicted example is 96.5 minutes. Thus, the total cycle interval for the first pump cycle is 100 minutes, where the pump is operated for only 3.5% of the interval period. The next pump cycle is approximately the same as the first pump cycle. This is typical of normal automatic operation, where the water level switch 15 turns on the pump when a threshold amount of water enters the bilge, and the pump evacuates the water at a constant rate every cycle. Accordingly, by averaging the current draw values and cycle values over numerous pump cycles, a consistent and reliable set of normal operating values can be determined.

The normal operating values are determined based on the values calculated for the pump cycles in the analysis set, such as for each of the predetermined number of pump cycles used in the running normal calculation. The normal operating values determined for a bilge pump 12 based on the current draw measurements over numerous pump cycles may include, a normal cycle interval, a normal pump-on duration, a normal pump-off duration, a normal peek current draw, a normal minimum current draw, a normal average current draw, etc. For example, a normal peak current draw may be determined by averaging the peak current draw for each pump cycle in the analysis set. A normal minimum current draw may be determined for each pump cycle, which may represent the average current draw during the running period for which no water was present (see FIG. 2). Thus, the normal minimum current draw may represent the amount of current that the bilge pump 12 is drawing during the portion of a normal run cycle where no water is present in the bilge. A normal average current draw can be calculated, such as by determining a current draw average for each pump cycle, and then averaging those average values determined for each interval in the set. A normal cycle interval may be determined by averaging the total pump cycle times for each pump cycle in the analysis set, which is the time between the start points of each cycle. A normal pump-on duration may be calculated as an average of the pump-on duration 71 for each pump cycle, and a normal pump-off duration may be calculated as an average of the pump-off durations 72 for each pump cycle in the analysis set. In certain embodiments, a water evacuation duration 74 may also be determined for each pump cycle, which is the period of time, based on the current draw measurements, for which the bilge pump 12 is operating to evacuate water. For example, the water evacuation duration 74 may be the period during which the current draw measurements are between the second threshold $T_2$ and the third threshold $T_3$. In certain embodiments, a normal water evacuation duration may be determined by averaging the water evacuation durations 74 for each of the pump cycles in the analysis set. Alternatively or additionally, a normal current draw pattern may be determined for a pump cycle, which may be determined by lining up the current draws for each measurement cycle and averaging the values at corresponding time points.

Figure 4:
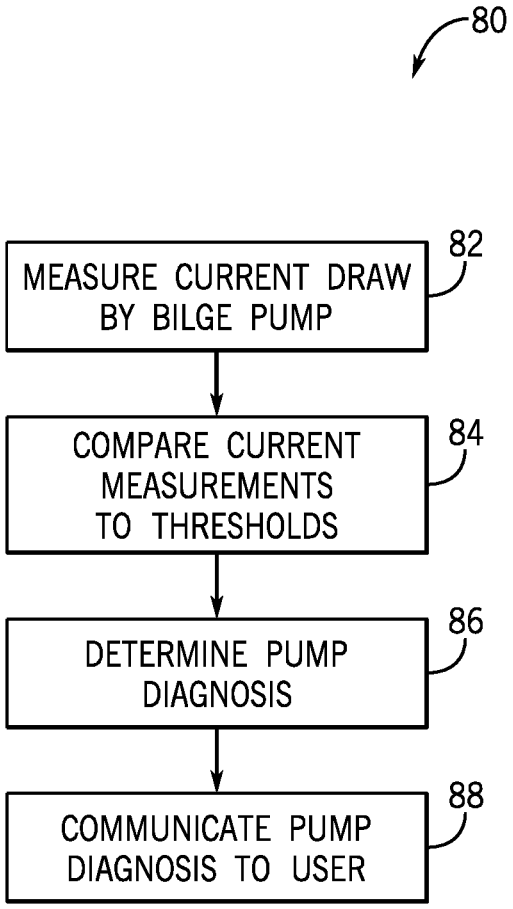
FIGS. 4-5 are flow charts depicting exemplary methods, or portions thereof, of monitoring a bilge pump on a marine vessel.

FIG. 4 depicts an exemplary method 80 that may be executed by the pump monitoring system 10, including executing instructions of the bilge monitor module 38. A current draw by the bilge pump is measured at step 82, such as continuous measurement of the current draw by the current sensor 24. One or more of the current measurements is compared to relevant thresholds at step 84, which may be preset threshold values and/or normal operating values determined as described herein. A pump diagnosis is determined at step 86, and the pump diagnosis is communicated to the user at step 88. For example, the pump diagnosis may be determined at the computing system housing the bilge monitor module 38, and diagnosis may be communicated via wireless means, such as via a cellular network, to a user device 64. In certain embodiments, the pump diagnosis may only be communicated to a user under certain conditions, such as where the pump diagnosis requires input or action by the user. For example, if the pump diagnosis is a failed motor, a failed wire harness, a blown fuse, a poor ground, or some other diagnosis that indicates non-operation of the bilge pump, then an immediate alert may be sent from the computing system, e.g., central computing system 55, to the user device 64. If, on the other hand, the pump diagnosis is normal, or abnormal but does not interfere with immediate operation of the bilge pump 12, than a more passive communication means may be used to communicate the information to the user. For example, an email or text may be sent to the user device 64 instructing the user to examine the bilge pump information to receive the bilge pump diagnosis.

Figure 5:
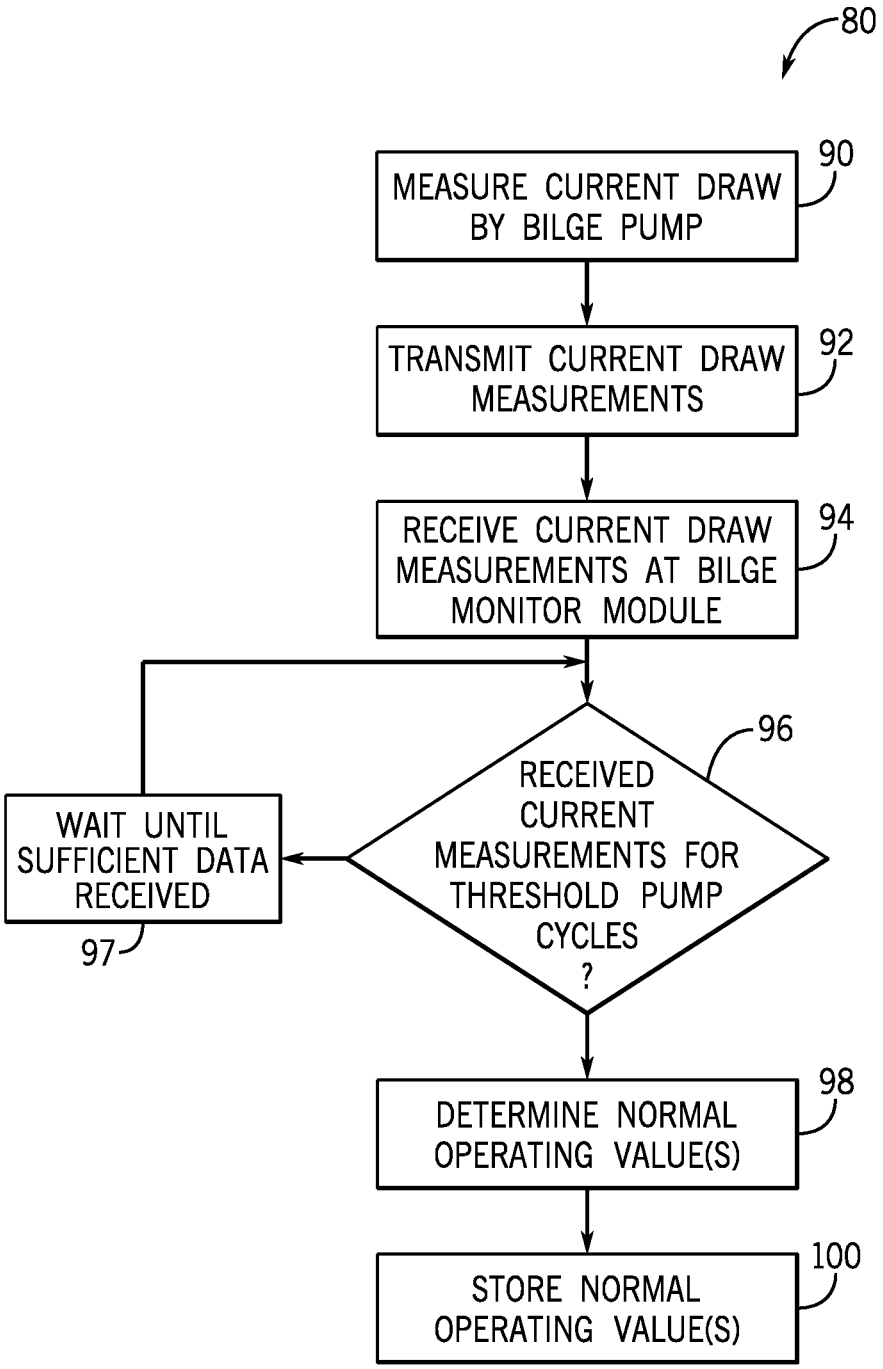

FIG. 5 depicts one embodiment of a method 80, or portion thereof, for calculating one or more normal operating values for the bilge pump 12. Current draw measurements are made at step 90, such as by the current sensor 24. The current draw measurements are transmitted at step 92, such as transmitted by the bilge control puck 20 to the hub computing system 42, or in certain embodiments directly to the central computing system 55. The current draw measurements are received at the computing system at step 94 and made available for use by the bilge monitor module 38. At step 96 the bilge monitor module 38 determines whether sufficient current measurements have been received to enable determination of one or more normal operating values. For example, the bilge monitor module 38 may determine whether current measurements are available for at least a threshold number of pump cycles, such as the predetermined number of previous pump cycles comprising a full data set, as described above, for calculation of the normal operating values. The normal operating values are then calculated at step 98, examples of which are detailed above. The normal operating values are stored at step 100, such as in memory of the respective storage system 59, 46 for later use by the bilge monitor module 38.

The table at FIG. 6 illustrates and exemplifies analysis that may be performed by the bilge monitor module 38 to generate a pump diagnosis based on the current draw measurement, including based on a comparison of current draw measurements for an ongoing pump cycle to normal operating values. Specifically, the table illustrates exemplary thresholds and logic that may be executed by the bilge monitor module 38 for three different modes. In a first mode, the bilge pump is operated by a water level switch 15, such as a float switch. The second mode is a manual mode where the pump is turned on by an operator using the dash switch 30. The third operating mode is a system control mode where the bilge pump 12 is turned on by the pump monitoring system 10, such as by controlling the relay 22 in the bilge control puck 20. Depending on the operating mode, the bilge monitor module 38 executes logic based on the current draw values, as compared to preset operating thresholds and normal operating values, to determine the diagnosis. In the example, the normal operating value is exemplified as the pump-on duration. In certain embodiments, the water evacuation duration 74 may be used in place of the pump-on duration 71. Other normal operating values may also be used as an alternative to or in addition to the pump-on duration.

For the float switch control mode, the current draw for an on-going pump cycle is compared to one or more thresholds to make an initial determination regarding pump function. As described above, the threshold values are determined based on a particular pump and electrical configuration on a particular marine vessel. In the depicted example, if the current draw is less than a threshold of 1 ampere, then an assumption is made that the pump is not running. In that case, the diagnosis may be determined as one or all of a blown fuse, a failed motor, a failed wire harness or a poor ground. In certain examples, voltage measurements at various locations in the wire harness may provide additional information as to the location of the problem. If the current draw for the ongoing pump cycle is between 1 amp and 2 amps, then an assumption is made that the pumps is running, but water is not present. Since the float switch should turn off the pump if water is not present, then the continued operation of the pump could indicate that the float switch has failed and thus is not turning the pump-off. Alternatively, the inlet to the pump may be clogged such that water is not getting to the pump. In certain embodiments, the diagnosis may be set as indicating that either one of the failed float switch or clogged inlet condition has occurred. In other embodiments, further tests may be conducted to determine which diagnosis is more accurate.

In still other embodiments, the bilge monitor module 39 may default to indicate one or the other diagnosis, such as setting the diagnosis equal to failed float switch. If the current draw measurements are between two and four amps, then the bilge pump 12 is operating to evacuate water from the bilge. If the current draw for the ongoing pump cycle exceeds 4 amps, then it is determined that the bilge pump 12 is drawing too much current, and the diagnosis is set equal to a failed motor or stuck impeller (which may be one or both of the diagnosis). Namely, a current draw above a certain high threshold is an indication of a stalled motor, meaning that the motor and pump shaft are not turning. This is most likely caused by something being caught in the pump, such as debris, or otherwise caused by a seized motor condition.

In certain embodiments, the current draw thresholds may, instead of being pre-set thresholds, be normal thresholds determined based on previous operating cycles as described above. Thereby, the current draw thresholds can adjust as the pump ages and the current draw changes. In addition to the current draw threshold comparison, the current draw of the ongoing pump cycle, or values calculated based thereon, are compared to corresponding normal operating values. In the depicted example, the pump-on duration calculated for an ongoing pump cycle (i.e., an ongoing pump-on duration) is compared to the normal pump-on duration. If the current draw is within the normal operating range of 2-4 amps, and the pump-on duration is shorter than a normal pump-on duration, then an assumption is made that water is present, but that the bilge pump is turning off too quickly. Specifically, since the location of the float switch is fixed, the water level at the start of operation is known, or at least approximately known.

Based on the normal operating values calculated previously, it is known how long the pump needs to operate in order to evacuate that amount of water. If the pump operates for less time, something is likely wrong because the pump operates at a consistent speed and is only capable of evacuating water at a set rate. Thus, the most likely cause of the problem is improper operation of the float switch to turn off the pump before all of the water is removed from the bilge. Thus, the diagnosis may then be set to failed float switch. If, on the other hand, the pump-on duration for the ongoing pump cycle is the same as the normal pump-on duration, or within a predetermined range of the normal pump-on duration, then the bilge pump is determined to be operating correctly and the diagnosis is set to normal.

If the ongoing pump-on duration exceeds the normal pump-on duration, such as by at least a threshold amount of time, then an assumption is made that water is present in the bilge, but that the water is not being evacuated as quickly as usual. Thus, the diagnosis is determined to be one of a clogged pump outlet 14, or excess water due to heavy rain or a major leak. In certain embodiments, the bilge monitor module may access to weather data based on a vessel location to determine whether heavy rain is occurring. For example, the bilge monitor module 38 may utilize the GPS location of the marine vessel to obtain relevant weather information, such as rainfall amounts. For example, the central computing system 55 may provide access to a weather data service allowing a weather data lookup based on GPS location measured by a GPS device on the marine vessel, or based on cell tower location of the cell tower used by the hub computing system 42 for communication with the central computing system 55. Thus, heavy rain can be identified or ruled out based on the weather data. If heavy rain is occurring, then the increased run time of the bilge pump 12 may not be indicated as a problem. However, if heavy rain is not indicated, then the increased or continued run time of the bilge pump 12 may indicate that water is accumulating in the bilge, which could be due to a severe leak or due to non-operation of the bilge pump. Logic can be executed as described herein to determine whether the bilge pump is operating. Either way, such water accumulation can be a severe problem.

During the manual mode operation by a user, the bilge monitor module 38 may only utilize the threshold values for the bilge pump diagnosis, as the normal values are less applicable where the on and off operation of the bilge pump is completely controlled by the user. Thus, the diagnosis analysis during the manual mode would track that described above for utilization of the threshold values. However, one additional piece of information may be utilized for diagnosis, which is that the position of the dash switch 30 is known to be in the manual position, based on the connection of the positive wire 18*a* to the bilge control puck 20. Thus, if the dash switch 30 is known to be in the manual position, but the current draw for the ongoing pump cycle is less than 1 amp, than the diagnosis may be determined as a failed relay switch 22. Additionally, if it is known that the dash switch 30 was switched to the manual position (such as a sensor in the dash switch 30, but the connection is not cinched at the bilge control puck 20, then it can be determined that the dash switch 30 has failed.

The analysis for the system control mode is similar to that described above for the automatic water level mode, where both the threshold values and the normal operating values can be utilized to determine the pump diagnosis. For example, the system control mode is utilized to control the bilge pump 12 based on the normal operating values, such as based on the normal cycle interval. In certain embodiments, the bilge monitor module 38 may operate in the system control mode to turn on the bilge pump at the beginning of each normal cycle interval, which as described above is the normal cycle time calculated based on the previous current draw measurements. Thus, the system 10 has the ability to turn on the pump periodically to check for proper pump function and/or proper function of the water level switch 15. In the depicted embodiment of the system 10, the pump is turned on by instructing the bilge control puck 20 to close the relay 22. For example, the bilge pump may be turned on based on the normal cycle interval, and it may be continually operated until the current draw falls below the relevant threshold indicating that no water remains in the bilge. That operation time is then compared to the normal pump-on duration to arrive at the diagnosis, which is provided in the table. In such an embodiment, since the system is being operated by an internal relay and not by the float switch, float switch failure can be ruled out. Thus, if the pump-on duration exceeds the normal pump-on duration, such as by at least a threshold amount, then it can be assumed that excess water remains in the bilge. Weather data can be utilized to rule out heavy rain and, if that is the case, then the diagnosis can be determined to be either a clogged outlet or a major leak, either of which indicate that excess water is accumulating in the bilge.

In certain embodiments, additional logic may be executed based on a voltage measurement across the bilge pump 12, such as provided by voltage sensor 34. For example, voltage measurement by the voltage sensor 34 may be compared to a threshold expected voltage measurement during operation of the pump. In certain embodiments, the voltage measurement by the voltage sensor 34 may be compared to one or more other voltage measurements at various points in the wiring harness and/or compared to a voltage measurement at the battery. Based on such voltage measurements, a location of a circuit break may be diagnosed. Accordingly, the voltage measurements during an ongoing pump cycle can be used to supplement the current draw measurements for determining the diagnosis. If a situation occurs where no data is received from the puck, such as a sudden loss of connection with the bilge control puck 20 or a loss of data receipt therefrom, then it can be determined that the bilge control puck has failed, and the diagnoses can be set accordingly.

Figure 7:
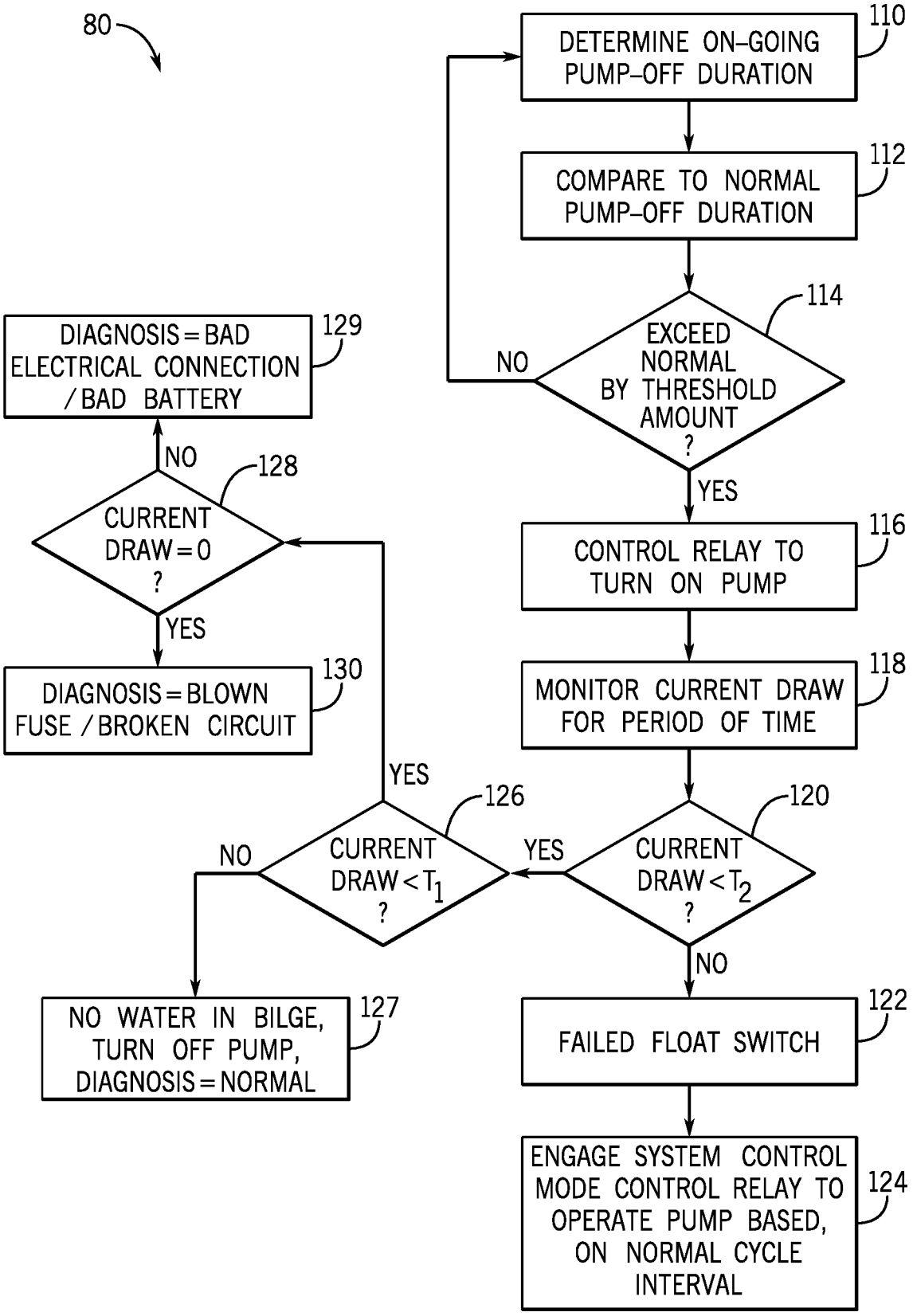
FIG. 7 is a flow char depicting another exemplary method of monitoring a bilge pump.

FIG. 7 depicts one embodiment of a method 80, or portion thereof, of monitoring a bilge pump. Specifically, FIG. 7 depicts steps that may be executed by the bilge monitor module 38 utilizing analysis of a pump-off duration 72. An ongoing pump-off duration is determined at step 110 based on the current draw measurements for the ongoing pump cycle. For example, the pump-off duration 72 may be determined according to the methods described and illustrated with respect to FIG. 3. The pump-off duration is compared to a normal pump-off duration at step 112. If the pump-off duration has exceeded the normal pump-off duration by at least a threshold amount at step 114, then the bilge pump 12 may be controlled by the system 10 to automatically turn on. For example, such logic may be executed when the bilge pump 12 is operating in the automatic mode according to a float switch.

If the float switch 15 has failed to turn on the bilge pump 12 within a certain threshold amount of time longer than the normal pump-off duration, then the bilge monitor module 38 may be configured to turn on the bilge pump 12 at step 116 to test its operation and determine whether water has accumulated in the bilge. As illustrated by step 118, the bilge pump 12 may be run, and the current draw monitored, for a predetermined period of time. For example, the period of time should be just slightly less than the normal pump-off duration. If during that period of time the current draw is less than the threshold indicating that water is being evacuated by the pump (e.g. the second threshold $T_2$ in FIG. 2), represented at step 120, then it can be determined that less water was in the bilge than would have triggered the float switch. Thus, it was not problematic that the float switch did not trigger operation of the bilge pump 12. However, if the current draw exceeds the relevant threshold for longer than the normal pump-on duration, then it can be determined that the float switch should have turned on. Accordingly, the diagnosis can be determined as a failed float switch at step 122. The system control mode can then be engaged at step 124 to control the relay and operate the pump based on the normal cycle interval.

If at step 120 the current draw does fall below the relevant threshold indicating that all water has been evacuated within the period of time set at step 118, then further logic may be executed to determine the proper diagnosis. Step 126 determines whether the current draw is less than a very low current threshold indicating that the pump is not operating at all (the first threshold $T_1$ in FIG. 2). If the pump is operating above that current draw threshold, then normal operation can be assumed, and the pump can be turned off at step 127. The diagnosis may also be set to normal. If during the test, the current draw from the pump is determined to be at or near 0 at step 128, then the diagnosis is indicated at step 130 as a blown fuse or broken circuit, namely, no current is flowing through the bilge pump 12. If the current draw is less than the low threshold $T_1$ but greater than 0, then the diagnosis may be set at step 129 as a bad electrical connection or a bad battery. In certain embodiments, a bad battery may be ruled out or decidedly diagnosed based on a voltage measurement at the battery 32.

In certain embodiments, the bilge monitor module 38 may be further configured to track the normal operating values over time to assess a wear condition of the bilge pump 12. For example, the bilge monitor module 38 may track the progress of the normal pump-on duration over time, which will be expected to increase as the bilge pump 12 becomes older and less efficient. Alternatively or additionally, the bilge monitor module 38 may track the average normal average current draw, normal minimum current draw, and/or the normal peak current draw to assess changes in one or more of those normal values over time. Increases in current draw over time also indicate wear on the bilge pump 12. In certain embodiments, the bilge monitor module 38 may compare the normal operating values to respective threshold values, or change threshold values, indicating that the wear condition of the bilge pump 12 is in need of attention. The bilge monitor module 38 may then generate an alter, such as a passive alert accessible via the user device 64, when the respective threshold value has been crossed. Thereby, a vessel owner or operator can be notified of the wear condition of the bilge pump 12 and can repair or replace the bilge pump 12 before failure occurs.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

I claim:

1. A bilge pump monitoring system for a bilge pump on a marine vessel comprising:

a current sensor configured to measure a current draw of the bilge pump;

a processor;

a bilge monitor module executable on the processor to:

determine at least one normal operating value for the bilge pump based on current draw measurements acquired over two or more previous pump cycles prior to an ongoing pump cycle;

receive current draw measurements by the current sensor;

determine a pump diagnosis of the bilge pump based on a comparison of the current draw measurements to the at least one normal operating value; and wirelessly communicate the pump diagnosis to a user located remotely from the marine vessel.

2. The bilge pump monitoring system of claim 1, wherein the normal operating value includes at least one of a normal peak current draw, a normal minimum current draw, a normal average current draw, a normal cycle interval, a normal pump-on duration, a normal water evacuation duration, and a normal pump-off duration.

3. The bilge pump monitoring system of claim 1, wherein the normal operating value is determined based on current draw measurements acquired over a predetermined number of previous pump cycles, wherein the normal operating value is redetermined after a specified interval.

4. The bilge pump monitoring system of claim 1, wherein the bilge monitor module is further configured to:

compare a current normal operating value determined based on the current draw measurements acquired over the two or more previous pump cycles to one or more previous normal operating values to determine a change in the normal operating value over time;

compare the change in the normal operating value over time to one or more thresholds to determine a wear condition of the bilge pump; and wirelessly communicate the wear condition to the user located remotely from the marine vessel.

5. The bilge pump monitoring system of claim 1, wherein the bilge monitor module is further configured to:

determine at least one of an ongoing peak current draw and an minimum current draw for an ongoing pump cycle;

compare at least one of the ongoing peak current draw to a normal peak current draw and the ongoing minimum current draw to a normal minimum current draw, wherein normal peak current draw and the normal minimum current draw are determined based on current draw measurements acquired over the two or more previous pump cycles; and determine the pump diagnosis based on the comparison.

6. The bilge pump monitoring system of claim 1, further comprising a relay operable to turn on the bilge pump;

wherein the bilge monitor module is further configured to:

calculate an ongoing pump-off duration for the ongoing pump cycle;

compare the ongoing pump-off duration to a normal pump-off duration, wherein the normal pump-off duration is determined based on current draw measurements acquired over the two or more previous pump cycles; and if the ongoing pump-off duration exceeds the normal pump-off duration by at least a threshold amount, then control the relay to automatically start the bilge pump.

7. The bilge pump monitoring system of claim 1, further comprising a voltage sensor configured to measure a voltage across the bilge pump;

wherein the pump monitor module is further configured to:

receive voltage measurements by the voltage sensor; and determine the pump diagnosis based further on the voltage measurements.

8. The bilge pump monitoring system of claim 1, wherein the pump diagnosis is a selected one of a failed float switch, a seized motor, a blown fuse, a failed wire harness, a poor ground, a clogged pump inlet, a clogged pump outlet, a heavy rain, a significant leak, and a failed dash switch.

9. The bilge pump monitoring system of claim 8, wherein determining the at least one normal operating condition includes conducting a trend analysis of the current draw measurements over a predetermined number of previous pump cycles or a predetermined amount of time prior to the ongoing pump cycle.

10. The bilge pump monitoring system of claim 1, wherein the bilge monitor module is further configured to:

calculate an ongoing pump-on duration for the ongoing pump cycle;

compare the ongoing pump-on duration to a normal pump-on duration, wherein the normal pump-on duration is determined based on current draw measurements acquired over the two or more previous pump cycles; and if the ongoing pump-on duration is within a threshold range less than the normal pump-on duration, then determine that the pump diagnosis is a failed float switch.

11. The bilge pump monitoring system of claim 10, wherein the system further comprises a relay operable to turn on the bilge pump;

wherein the bilge monitor module is further configured to:

determine a normal cycle interval based on current draw measurements acquired over the two or more previous pump cycles; and control the relay to automatically start the bilge pump based on the normal cycle interval.

12. A method of monitoring a bilge pump on a marine vessel, the method comprising:

operating a current sensor to measure a current draw of the bilge pump;

acquiring current draw measurements over two or more pump cycles of the bilge pump prior to an ongoing pump cycle;

determining, at a processor, at least one normal operating value for the bilge pump based on the acquired current draw measurements over the two or more prior pump cycles;

storing the at least one normal operating value in a storage system accessible by the processor;

operating the current sensor to measure a current draw of the bilge pump during the ongoing pump cycle; and determining a pump diagnosis for the bilge pump based on the current draw measurements for the ongoing pump cycle and the at least one normal operating value.

13. The method of claim 12, further comprising:

comparing the current draw measurements for the ongoing pump cycle to the at least one normal operating value;

wherein the pump diagnosis is determined, based on the comparison, to be one of a failed float switch, a seized motor, a blown fuse, a failed wire harness, a poor ground, a clogged pump inlet, a clogged pump outlet, a heavy rain, a significant leak, and a failed dash switch.

14. The method of claim 12, further comprising:

operating a voltage sensor to measure a voltage across the bilge pump;

receiving voltage measurements by the voltage sensor during the ongoing pump cycle; and determining the pump diagnosis based further on the voltage measurements.

15. The method of claim 12, wherein the normal operating value includes at least one of a normal peak current draw, a normal minimum current draw, a normal average current draw, a normal cycle interval, a normal pump-on duration, a normal water evacuation duration, and a normal pump-off duration.

16. The method of claim 15, further comprising:

determining at least one of an ongoing peak current draw and an ongoing minimum current draw for the ongoing pump cycle;

comparing at least one of the ongoing peak current draw to the normal peak current draw and the ongoing minimum current draw to the normal minimum current draw; and determining the pump diagnosis based on the comparison.

17. The method of claim 15, further comprising:

calculating an ongoing pump-on duration for the ongoing pump cycle;

comparing the ongoing pump-on duration to a normal pump-on duration, wherein the normal pump-on duration is determined based on current draw measurements acquired over the two or more previous pump cycles; and determining that the pump diagnosis is a failed float switch if the ongoing pump-on duration is within a threshold range less than the normal pump-on duration.

18. The method of claim 17, further comprising controlling a relay to automatically turn on the bilge pump based on the normal cycle interval.

19. The method of claim 15, further comprising:

calculating an ongoing pump-off duration for the ongoing pump cycle;

compare the ongoing pump-off duration to a normal pump-off duration, wherein the normal pump-off duration is determined based on current draw measurements acquired over two or more previous pump cycles; and controlling a relay to automatically start the bilge pump if the ongoing pump-off duration exceeds the normal pump-off duration by at least a threshold amount;

measuring a current draw of the bilge pump for at least a period of time;

controlling the relay to automatically stop the bilge pump if the current draw is within a no water range; and if the current draw is within a normal operation range after the period of time, determining that the pump diagnosis is a failed float switch and then engaging a system control mode wherein the relay is operated to automatically start the bilge pump based on the normal cycle interval.

20. The method of claim 15, further comprising:

calculating an ongoing pump-on duration for an ongoing pump cycle;

comparing the ongoing pump-on duration to a normal pump-on duration, wherein the normal pump-on duration is determined based on current draw measurements acquired over the two or more previous pump cycles;

determining that the ongoing pump-on duration is within a first threshold range greater than the normal pump-on duration;

automatically accessing a weather information based on a vessel location to determine a weather condition at the marine vessel; and determining, based on the pump-on duration for the ongoing pump cycle and the weather information, that the pump diagnosis is one of a clogged pump outlet, heavy rain, and significant leak.

* * * * *